US010292884B2

(12) United States Patent
Silverstein et al.

(10) Patent No.: US 10,292,884 B2
(45) Date of Patent: May 21, 2019

(54) SUPPORT FRAME

(71) Applicant: Lucent Medical Systems, Inc., Kirkland, WA (US)

(72) Inventors: Fred E. Silverstein, Seattle, WA (US); Curtis S. King, Kirkland, WA (US); Robert N. Golden, Kirkland, WA (US); Steve Vincent, Kirkland, WA (US)

(73) Assignee: Lucent Medical Systems, Inc., Kirkland, WA (US)

( * ) Notice: Subject to any disclaimer, the term of this patent is extended or adjusted under 35 U.S.C. 154(b) by 319 days.

(21) Appl. No.: 15/074,952

(22) Filed: Mar. 18, 2016

(65) Prior Publication Data

US 2017/0281443 A1 Oct. 5, 2017

Related U.S. Application Data

(60) Provisional application No. 62/135,557, filed on Mar. 19, 2015.

(51) Int. Cl.
*A61G 7/10* (2006.01)
*A61G 7/053* (2006.01)

(52) U.S. Cl.
CPC ..... *A61G 7/1038* (2013.01); *A61G 7/053* (2013.01); *A61G 7/1011* (2013.01); *Y10S 297/10* (2013.01)

(58) Field of Classification Search
CPC ..... A61G 7/1011; A61G 7/1038; A61G 2200/036; A61G 2200/32; A61G 7/053; Y10S 297/10
USPC ..... 135/65; 5/81.1 R, 662; 482/141
See application file for complete search history.

(56) References Cited

U.S. PATENT DOCUMENTS

| | | | | |
|---|---|---|---|---|
| 2,229,411 A | | 1/1941 | Hughes | |
| 2,305,249 A | | 12/1942 | Frost | |
| 2,565,257 A | | 8/1951 | Nichol | |
| 2,666,640 A | * | 1/1954 | Jennings, Sr. | A63B 3/00 482/141 |
| 3,077,347 A | | 2/1963 | Nova | |
| D208,607 S | * | 9/1967 | Williams | 135/67 |
| 3,572,701 A | * | 3/1971 | Agamian | A63B 22/203 482/132 |
| 3,591,173 A | * | 7/1971 | Cossman | A63B 21/00047 135/67 |

(Continued)

FOREIGN PATENT DOCUMENTS

| | | | | |
|---|---|---|---|---|
| WO | WO-8402660 A1 | * | 7/1984 | A63B 21/00047 |
| WO | WO-2015183571 A1 | * | 12/2015 | A61G 7/1038 |

*Primary Examiner* — Robert Canfield
(74) *Attorney, Agent, or Firm* — Seed IP Law Group LLP

(57) ABSTRACT

A support structure device is configured to assist a human patient to rise. The support structure includes a tube bent into a shape described by way of a reference frustum such as a four-sided truncated pyramid. Each side of a top rectangular perimeter of the frustum is shorter than a corresponding side of the bottom rectangular perimeter, and each parallel side of a first trapezoidal perimeter of the frustum is shorter than a corresponding parallel side of a second trapezoidal perimeter. The reference frustum has a height between 10 and 18 inches, the top rectangular perimeter has a length between 10 and 16 inches and a width between 6 and 14 inches, and the bottom rectangular perimeter has a length between 12 and 18 inches and a width between 8 and 16 inches.

20 Claims, 16 Drawing Sheets

(56) References Cited

U.S. PATENT DOCUMENTS 3,739,793 A * 6/1973 Wilson ..... A47K 17/026 135/67
3,800,815 A 4/1974 Birk
4,018,439 A 4/1977 Kauk
4,021,033 A 5/1977 Auclair et al.
4,094,331 A 6/1978 Rozsa
4,180,086 A 12/1979 Thomas
4,232,863 A * 11/1980 Roach ..... A63B 21/00047 482/141
4,270,234 A * 6/1981 James ..... A61G 7/1015 5/88.1
4,700,730 A 10/1987 Samuelson et al.
4,763,756 A * 8/1988 Horan ..... A47C 9/027 182/20
4,777,973 A 10/1988 Nakajima
4,941,495 A * 7/1990 Boyce ..... A61G 7/053 135/65
4,993,446 A 2/1991 Yarbrough
5,005,599 A 4/1991 Cunningham
5,201,333 A 4/1993 Shalmon et al.
D365,314 S * 12/1995 Heisinger ..... D12/130
5,527,252 A * 6/1996 Sather ..... A63B 21/00047 482/131
5,813,948 A 9/1998 Quigg et al.
7,373,942 B1 5/2008 Yeager
7,862,122 B1 * 1/2011 Shammas ..... B60N 2/245 297/411.23
8,186,367 B1 5/2012 Le tran et al.
8,479,327 B2 7/2013 McKenney
8,608,183 B2 12/2013 Woo
8,667,976 B2 3/2014 Huang
8,733,379 B2 5/2014 Kwon
2002/0133878 A1 * 9/2002 O'Connell ..... A61G 7/053 5/81.1 R
2006/0272691 A1 12/2006 DeLesline
2008/0051273 A1 * 2/2008 Storch ..... A63B 21/00047 482/141
2008/0276977 A1 11/2008 Jowett et al.
2009/0124471 A1 * 5/2009 Storch ..... A63B 21/00047 482/141
2014/0265457 A1 9/2014 Welch et al.
2017/0189252 A1 * 7/2017 Silver ..... A61G 5/14

* cited by examiner

200

Angle:
A-E = 100° to 130°.
A-H = 95° to 130°.
A-I = 50° to 85°.
A-L = 50° to 85°.

B-E = 100° to 130°.
B-F = 95° to 130°.
B-I = 50° to 85°.
B-J = 50° to 85°.

C-F = 95° to 130°.
C-G = 100° to 130°.
C-J = 50° to 85°.
C-K = 50° to 85°.

Angle:
D-G = 105° to 130°.
D-H = 95° to 130°.
D-K = 50° to 85°.
D-L = 50° to 85°.

E-F = 90°.
F-G = 90°.
G-H = 90°.
H-E = 90°.

I-J = 90°.
J-K = 90°.
K-L = 90°.
L-I = 90°.

Length:
A = 8" to 20".
B = 8" to 20".
C = 8" to 20".
D = 8" to 20".

E = 8" to 20".
F = 8" to 20".
G = 8" to 20".
H = 8" to 20".

I = 8" to 20".
J = 8" to 20".
K = 8" to 20".
L = 8" to 20".

600

SUPPORT FRAME

BACKGROUND

Technical Field

The present disclosure generally relates to a support frame used to help a person rise up from a floor or the ground. More particularly, but not exclusively, the present disclosure relates to a vertically stable support structure sufficient for an infirmed person to lean on as the person rises from the floor or the ground.

Description of the Related Art

After many medical procedures, such as hip or knee replacement, a patient finds it difficult to rise from the floor or from ground level. In some cases, pain prevents the patient from moving their knee below their body such that they can begin the process to rise. In other cases, the artificial joint does not provide a full range of motion, and once again, the patient is not physically or comfortably able to move their knee below their body. In many cases, the condition persists long after the post-operative recovery of the patient and the person has resumed a normal life.

The subject matter discussed in the Background section is not necessarily prior art and should not be assumed to be prior art merely as a result of its discussion in the Background section. Along these lines, any recognition of problems in the prior art discussed in Background section or associated with such subject matter should not be treated as prior art unless expressly stated to be prior art. Instead, the discussion of any subject matter in the Background section should be treated as part of the inventor's approach to the particular problem, which in and of itself may include inventive subject matter.

BRIEF SUMMARY

In accordance with some embodiments described herein, a vertically stable support structure is provided. A mobility-restricted person can use the device to rise up from the floor or the ground by placing their hands on the support structure and lifting their head and torso sufficiently up that the person can move their leg below their body and thus begin the process of rising. The person may rise to a full standing position, or the person may rise enough to lean or sit on another structure.

In a first embodiment, a method is performed by a human being to stand. The human being has a body, two hands, two legs, two feet, and at least one debilitated joint. A first act includes positioning a support structure in front of the human being. The support structure is described by way of a reference frustum, which has a first planar side and a third planar side each having a first trapezoidal perimeter, a second planar side and a fourth planar side each having second trapezoidal perimeter, a planar top having a first rectangular perimeter, and a planar bottom having a second rectangular perimeter. Each side of the first rectangular perimeter is shorter than a corresponding side of the second rectangular perimeter, and each parallel side of the first trapezoidal perimeter is shorter than a corresponding parallel side of the second trapezoidal perimeter. The reference frustum has a height between 10 and 20 inches, the first rectangular perimeter has a length between 10 and 16 inches, the first rectangular perimeter has a width between 6 and 14 inches, the second rectangular perimeter has a length between 12 and 18 inches, and the second rectangular perimeter has a width between 8 and 16 inches. The support structure has horizontal support parts including a first horizontal support member corresponding to a first edge of the reference frustum formed by the first planar side and the planar top, and the support structure has a second horizontal support member corresponding to a second edge of the reference frustum formed by the third planar side and the planar top. The support structure has vertical support parts including a first vertical part corresponding to a third edge of the reference frustum formed by the first planar side and the second planar side, a second vertical part corresponding to a fourth edge of the reference frustum formed by the second planar side and the third planar side, a third vertical part corresponding to a fifth edge of the reference frustum formed by the third planar side and the fourth planar side, and a fourth vertical part corresponding to a sixth edge of the reference frustum formed by the fourth planar side and the first planar side. In the method, the human being grasps the first horizontal support member with a first of the two hands, grasps the second horizontal support member with a second of the two hands, swings a first of the two legs at least partially under the body, supports at least a first portion of the body through the two hands grasping the support structure, supports at least a second portion of the body with the first of the two legs, and raises the body upwards to a standing position.

In a second embodiment, a support structure device to assist a human patient to rise includes one or more substantially tubular components formed into a shape described by way of a reference frustum. The reference frustum has a first planar side and a third planar side each having a first trapezoidal perimeter, a second planar side and a fourth planar side each having second trapezoidal perimeter, a planar top having a first rectangular perimeter, and a planar bottom having a second rectangular perimeter. Each side of the first rectangular perimeter is shorter than a corresponding side of the second rectangular perimeter, and each parallel side of the first trapezoidal perimeter is shorter than a corresponding parallel side of the second trapezoidal perimeter. The reference frustum has a height between 10 and 20 inches, the first rectangular perimeter has a length between 10 and 16 inches, the first rectangular perimeter has a width between 6 and 14 inches, the second rectangular perimeter has a length between 12 and 18 inches, and the second rectangular perimeter has a width between 8 and 16 inches.

In another embodiment, a support frame assists a human being to move upwards. The human being has two arms, two hands, two legs, and at least one infirmed joint. The support frame has a single conduit structure suitably bent into a shape described by way of a reference frustum. The reference frustum has a first planar side and a third planar side each having a first trapezoidal perimeter, a second planar side and a fourth planar side each having second trapezoidal perimeter, a planar top having a first rectangular perimeter, and a planar bottom having a second rectangular perimeter. Each side of the first rectangular perimeter is shorter than a corresponding side of the second rectangular perimeter, and each parallel side of the first trapezoidal perimeter is shorter than a corresponding parallel side of the second trapezoidal perimeter. The reference frustum has a height between 10 and 20 inches, the first rectangular perimeter has a length between 10 and 16 inches, the first rectangular perimeter has a width between 6 and 14 inches, the second rectangular perimeter has a length between 12 and 18 inches, and the second rectangular perimeter has a width between 8 and 16 inches.

These features with other objects and advantages which will become subsequently apparent reside in the details of construction and operation as more fully described hereafter and claimed, reference being had to the accompanying drawings forming a part hereof. This Brief Summary has been provided to introduce certain concepts in a simplified form that are further described in detail below in the Detailed Description. Except where otherwise expressly stated, the summary is not intended to identify key or essential features of the claimed subject matter, nor is it intended to limit the scope of the claimed subject matter.

BRIEF DESCRIPTION OF THE SEVERAL VIEWS OF THE DRAWINGS

Non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. One or more embodiments are described hereinafter with reference to the accompanying drawings in which.

DETAILED DESCRIPTION

Hips and knees of human beings can fail or be injured. Sometimes, the person will endure the pain, discomfort, and reduced mobility associated with the damaged joint. Other times, the person will undergo a surgical operation to replace the failing or injured joint with an artificial joint. Even when surgery is successful, some pain, discomfort, and reduced mobility may remain.

Frequently, people with affected hips and knees have difficulty raising their body off of the ground or a floor. In some cases, pain or discomfort prevents the person from positioning one of their legs below their body. In other cases, reduced mobility of one or both legs prevents such positioning. In these cases, if the person does not have a piece of furniture, a wall, or some other support mechanism nearby, it is very difficult or even impossible for the person to get up.

Recognizing the problems faced by people with one or more debilitated joints, the inventors created a support structure with many benefits.

Figure 1:
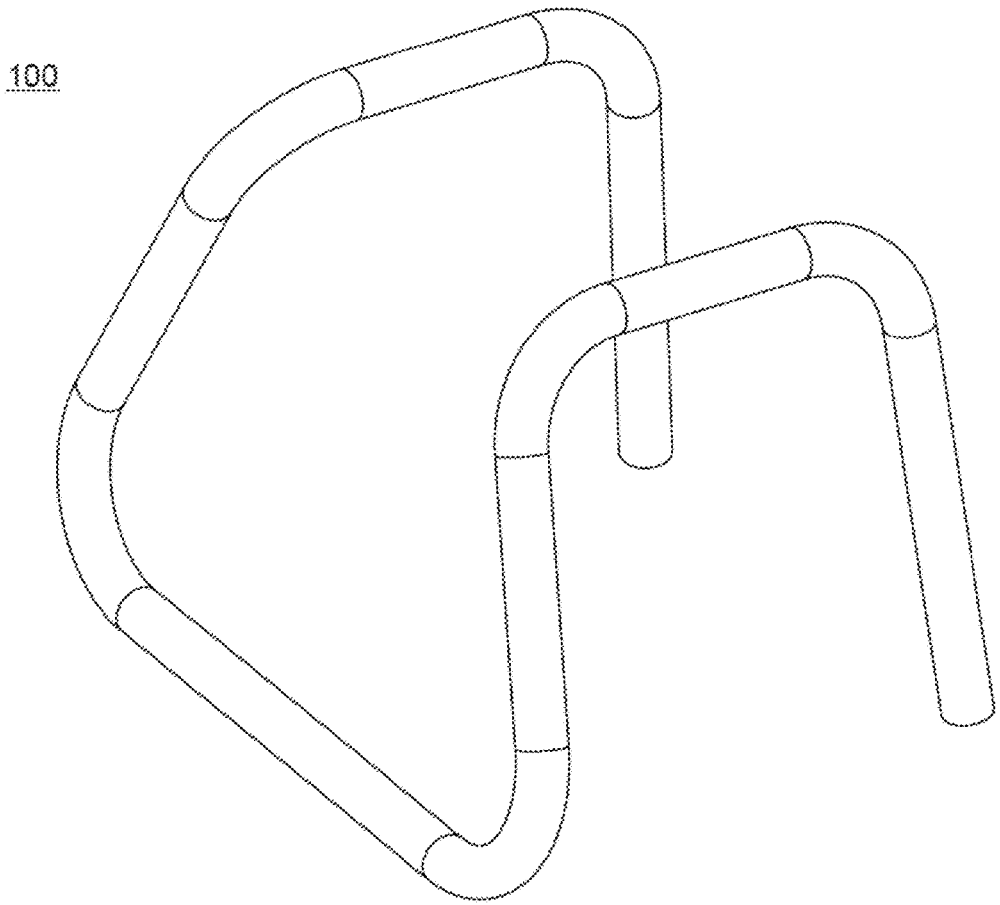
FIG. 1 is a perspective view of a support structure embodiment.

FIG. 1 is a perspective view of a support structure 100 embodiment. The support structure 100 is used by a person having at least one debilitated joint to raise their body off of the floor or the ground. Using the support structure 100, the person is often able to stand up very quickly and efficiently.

An example of use of the support structure 100 is now described. In this case, the person is aware of their debilitated joint (e.g., artificial knee, artificial hip, or the like). The person is also aware they will be lowering their body to ground level so as to exercise, for example, or to retrieve an item that has fallen on the floor, to work in a garden, or for some other reason. In this case, the person will put the support structure 100 nearby and accessible to the place on the ground or floor where the person will be, and the person will then lower their body to the ground or floor. When the person wishes to raise their body upwards to a standing position or, for example, to sit on a chair, the person will position the support structure 100 in front of themselves. The person will grasp one of the horizontal members of the support structure 100 with their left hand and the other horizontal member with their right hand. Using the support structure 100 for support and stability, the person may begin raising their upper body, and the person will swing one of their legs at least partially under their body. At this time, some portion of the person's body will be supported through their hands, which are grasping the horizontal members of the support structure 100. The person may optionally draw their other leg at least partially under their body. Once the person has at least one leg positioned under their body, the person will support at least a portion of their body with their leg, and upon doing so, the person will raise their body upwards off of the ground or floor.

Figure 2A:
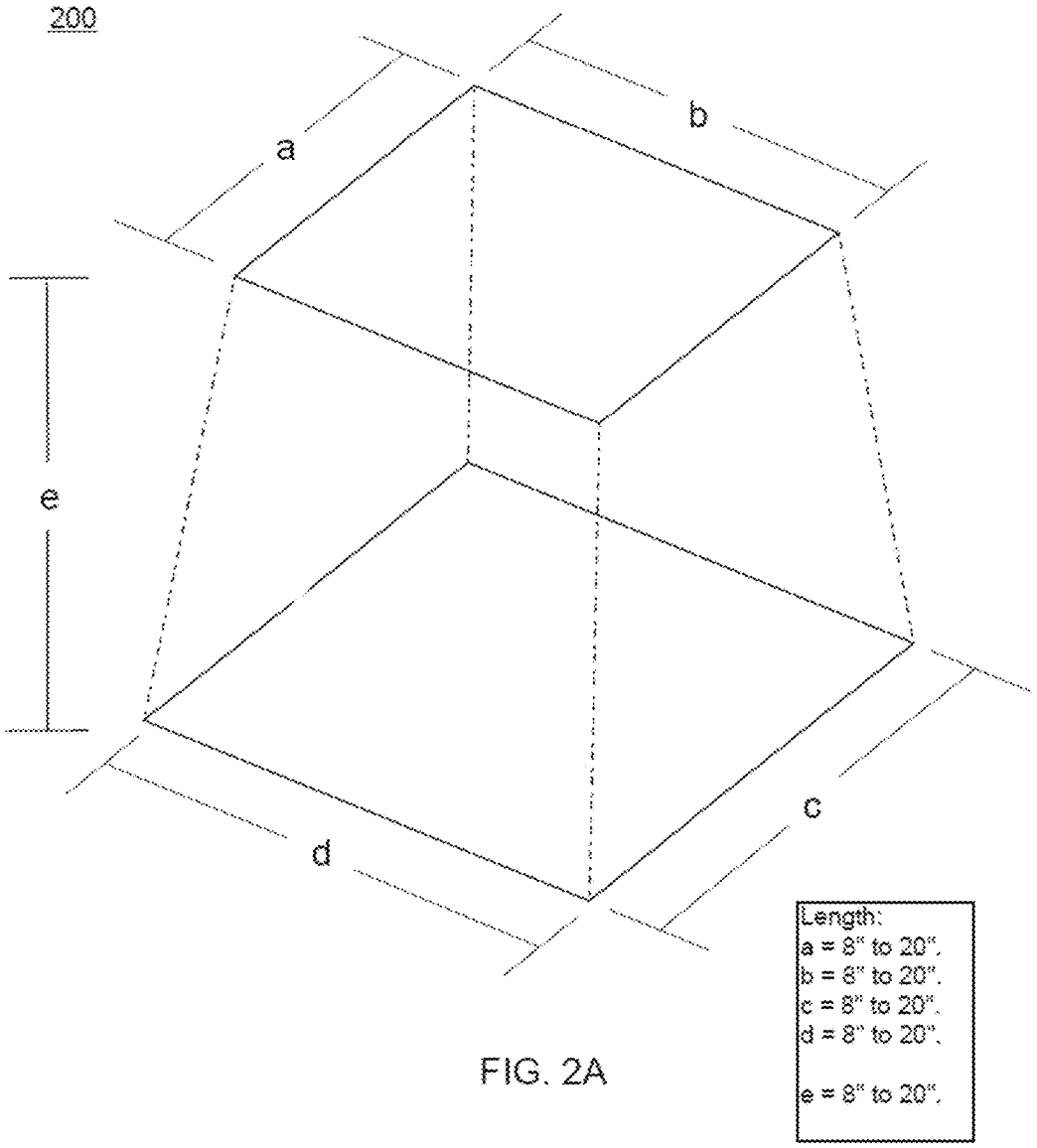
FIG. 2A is a reference frustum.

FIG. 2A is a reference frustum 200. Table 1 presents associated dimensions of the illustrated frustum.

TABLE 1

Reference Frustum Dimensions - Length

| Reference | Length |
|---|---|
| a | about 8" to 20" |
| b | about 8" to 20" |
| c | about 8" to 20" |
| d | about 8" to 20" |
| e | about 8" to 20" |

The reference frustum 200 may also be described herein as a truncated four-sided pyramid. The frustum 200 will have a rectangular footprint or a square footprint.

Figure 2B:
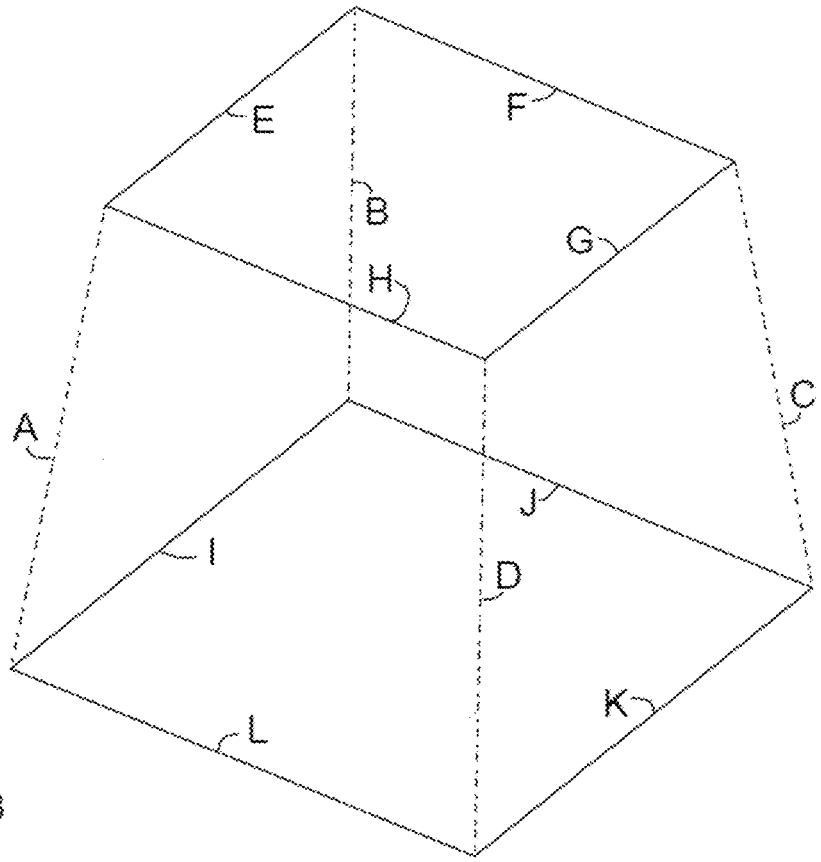
FIG. 2B is the reference frustum of FIG. 2A with reference labels identifying each edge of the frustum.

FIG. 2B is the reference frustum of FIG. 2A with reference labels identifying each edge of the frustum. Table 2 presents associated angles of the reference frustum.

TABLE 2

Reference Frustum Dimensions - Angles

| Ref. | Angle | Ref. | Angle |
|---|---|---|---|
| A-E | about 100°-130° | B-E | about 100°-130° |
| A-H | about 95°-130° | B-F | about 95°-130° |
| A-I | about 50°-85° | B-I | about 50°-85° |
| A-L | about 50°-85° | B-J | about 50°-85° |
| C-F | about 95°-130° | D-G | about 100°-130° |
| C-G | about 100°-130° | D-H | about 95°-130° |
| C-J | about 50°-85° | D-K | about 50°-85° |
| C-K | about 50°-85° | D-L | about 50°-85° |
| E-F | about 90° | I-J | about 90° |
| F-G | about 90° | J-K | about 90° |
| G-H | about 90° | K-L | about 90° |
| H-E | about 90° | L-I | about 90° |

Figure 2C:
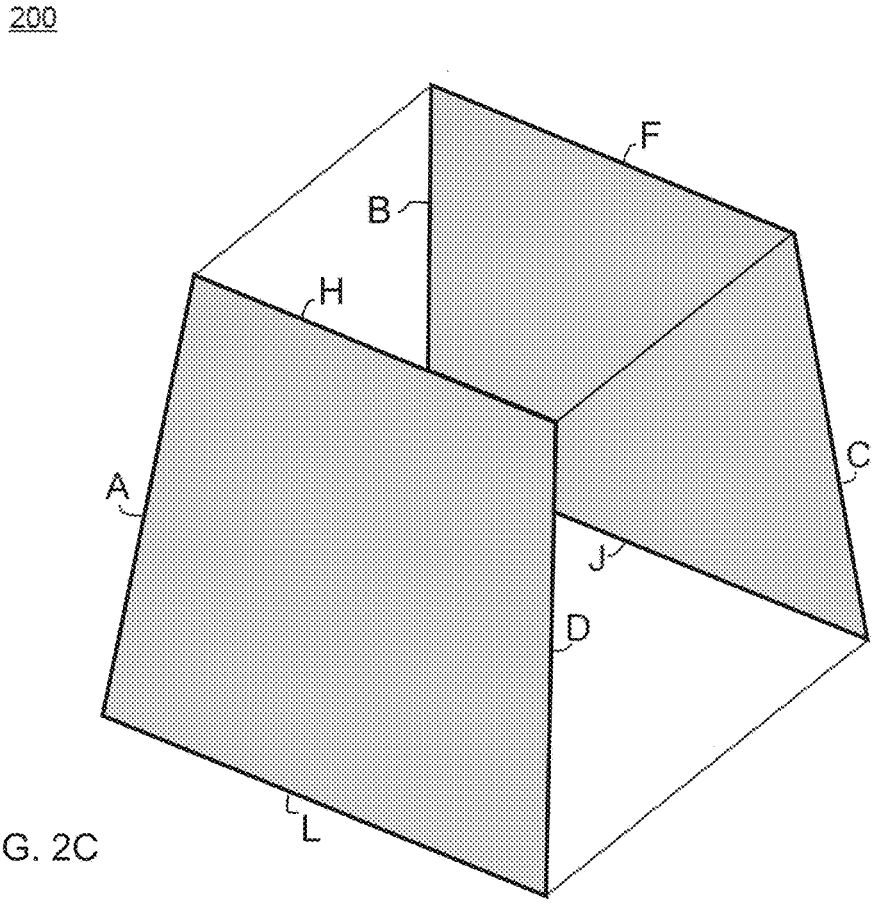
FIG. 2C is the reference frustum of FIG. 2A with the first and third sides emphasized.
Figure 2D:
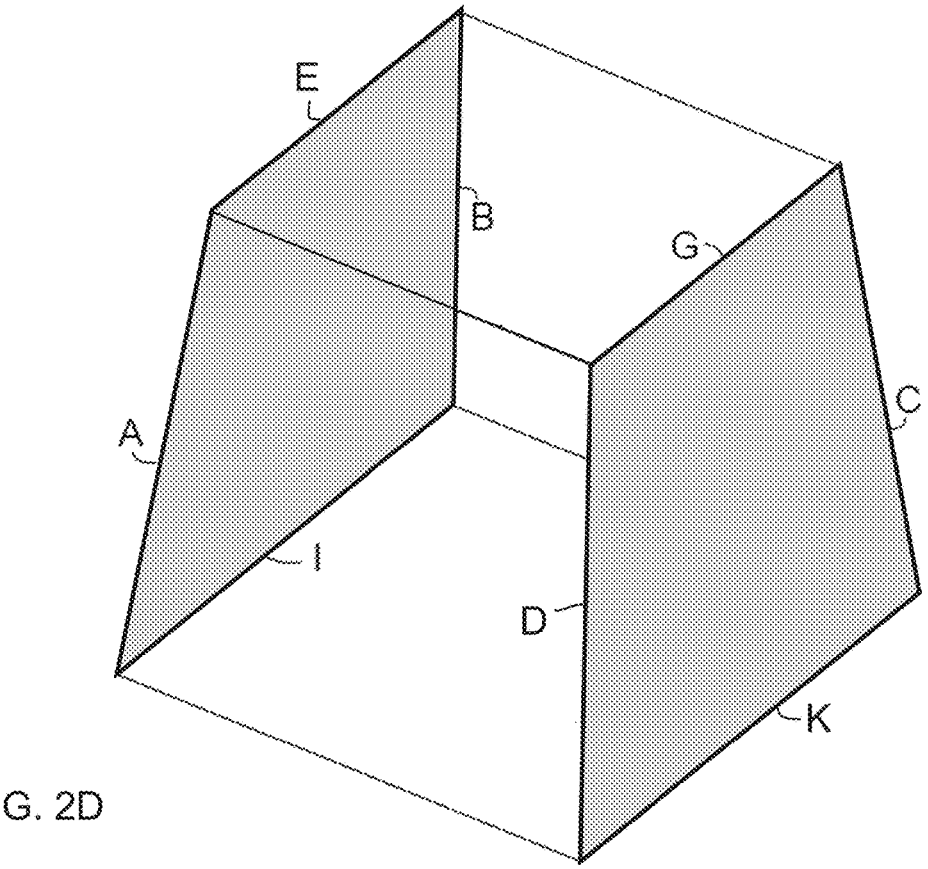
FIG. 2D is the reference frustum of FIG. 2A with the second and fourth sides emphasized.

In the reference frustum 200, a first planar side AHDL and a third planar side BFCJ each have a first trapezoidal perimeter. A second planar side CGDK and a fourth planar side BEAI each have a second trapezoidal perimeter. To improve clarity, FIGS. 2C and 2D are presented. FIG. 2C is the reference frustum of FIG. 2A with the first and third sides emphasized, and FIG. 2D is the reference frustum of FIG. 2A with the second and fourth sides emphasized;

A planar top EFGH of the reference frustum 200 forms a first rectangular perimeter, and a planar bottom IJKL forms a second rectangular perimeter. In some embodiments, each side of the first rectangular perimeter is shorter than a corresponding side of the second rectangular perimeter. In some embodiments, each side of the first rectangular perimeter is substantially the same length as a corresponding side of the second rectangular perimeter.

Figure 3:
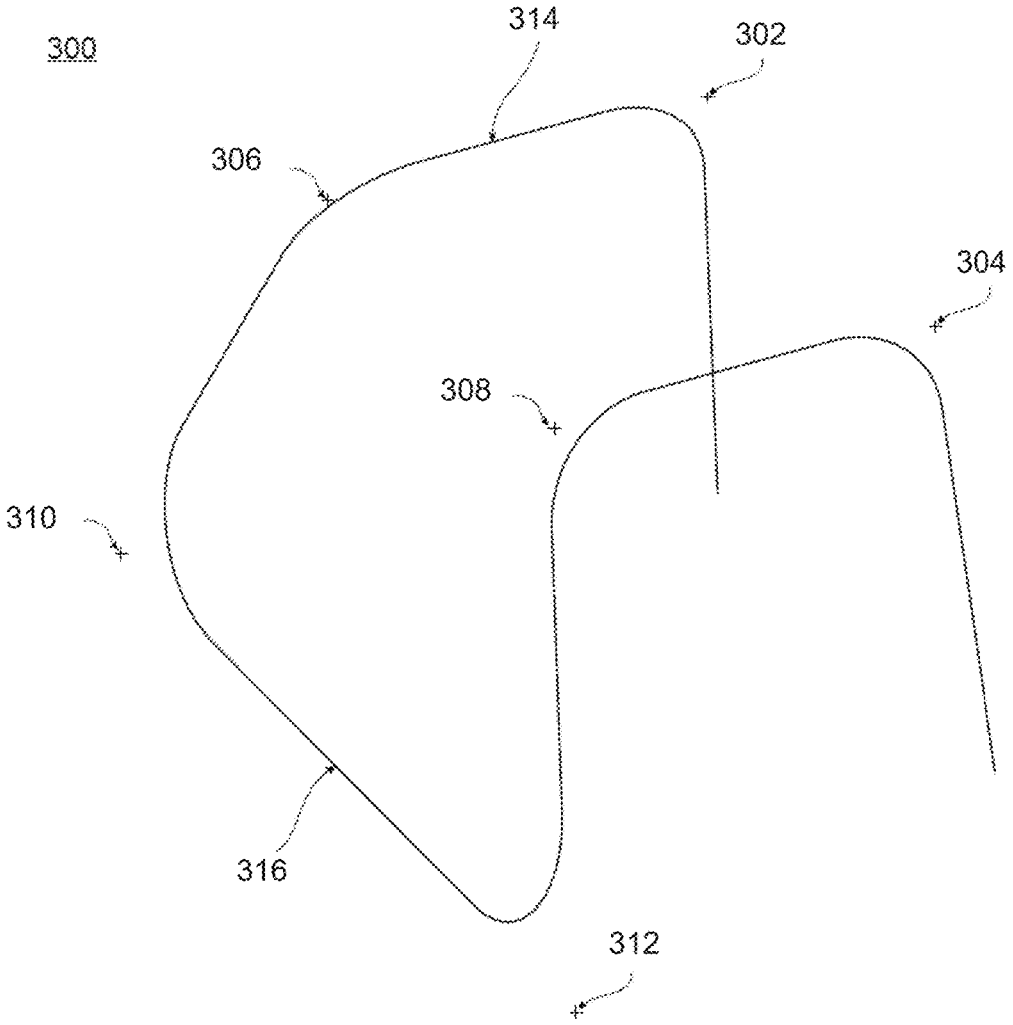
FIG. 3 illustrates a centerline of the support structure embodiment of FIG. 1.

FIG. 3 illustrates a centerline 300 of the support structure 100 embodiment illustrated in FIG. 1. The support structure 100 may be formed from tubular material, square material, or a material having some other shape, form, or profile. The support structure may be substantially hollow, substantially solid, or completely solid. In some embodiments, the support structure 100 is formed from a metal such as steel (e.g., stainless steel), aluminum, and platinum. In some embodiments, the support structure 100 is formed from a metal alloy such as an aluminum alloy. In still other embodiments, the support structure 100 is formed from a composite material; for example, a fiberglass material combined with other materials such as graphite, Kevlar, or wood. Some embodiments may also be formed from other nonmetallic materials such as wood, fiberglass, molded plastic, thermosetting plastics (e.g., epoxy), polyester resin, acrylic, and the like. In at least some part due to the range of shapes and materials that are considered for use in the support structure 100, the support structure can be described according to the centerline 300.

Also in FIG. 3, the centerline 300 is illustrated with particular rounded corners 302 to 312 and linear portions 314, 316. The radius of the rounded corners may range from about 0.5 inches to about 10 inches, but other radii are also contemplated.

Figure 4:
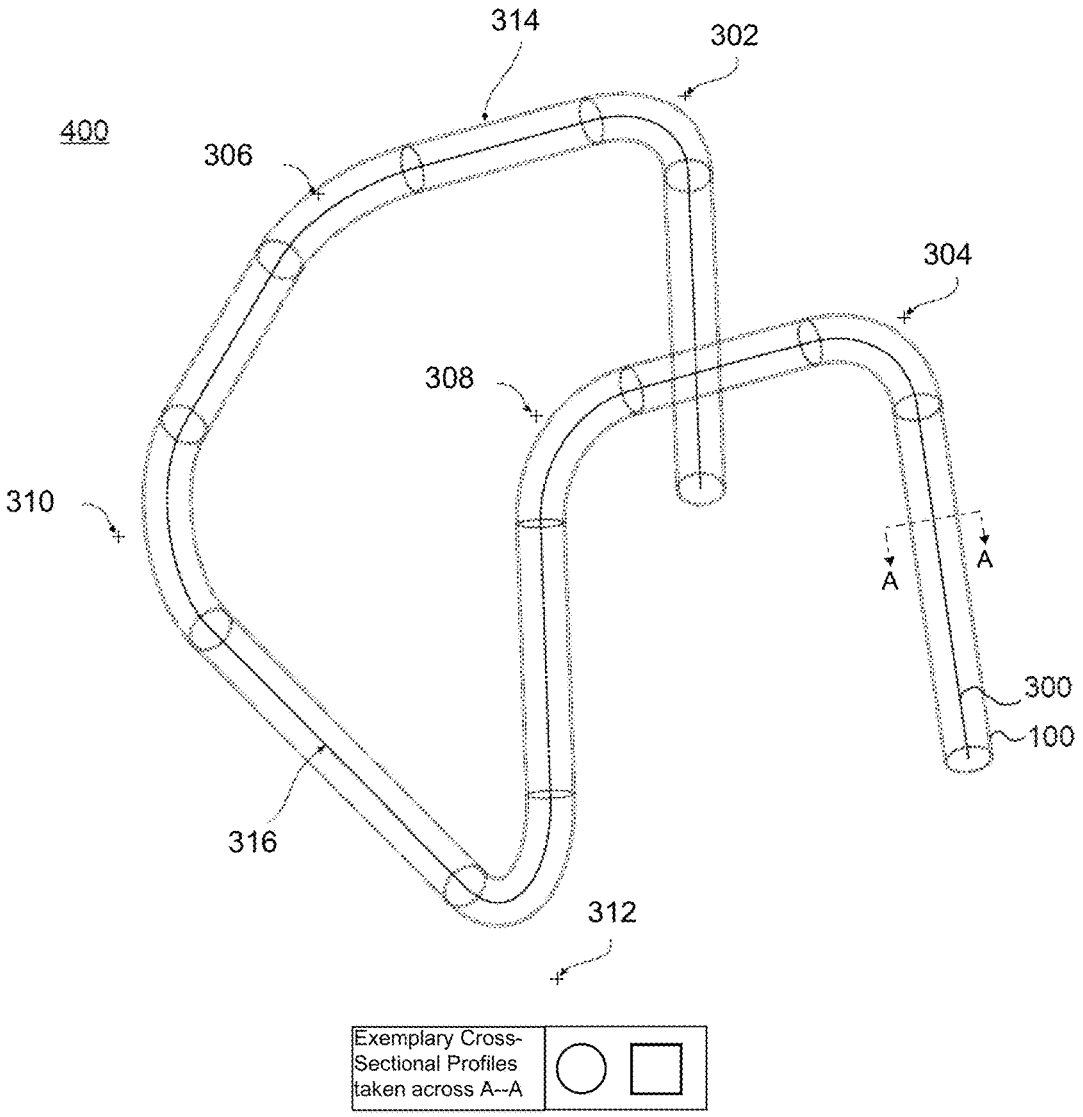
FIG. 4 is the support structure embodiment of FIG. 1 about the centerline of FIG. 3.

The support structure embodiment 400 of FIG. 4 illustrates the support structure 100 of FIG. 1 about the centerline 300 of FIG. 3, The rounded corners 302 to 312 and linear portions 314, 316 are illustrated for clarity. In the embodiment 400, the support structure 100 is shown in dashed lines to illustrate that centerline 300 is substantially at the geometric center of the tube that forms the support structure 100. In some embodiments, the support structure 100 is formed from a single tube. In other embodiments the support structure 100 is formed from a plurality of tube segments. In FIG. 4, several circular rings are illustrated as dashed lines to convey an understanding that the support structure 400 embodiment is formed front tubular material. Support structures having other cross-sectional shapes, including multiple cross-sectional shapes in the same structure, are also contemplated.

Figure 5:
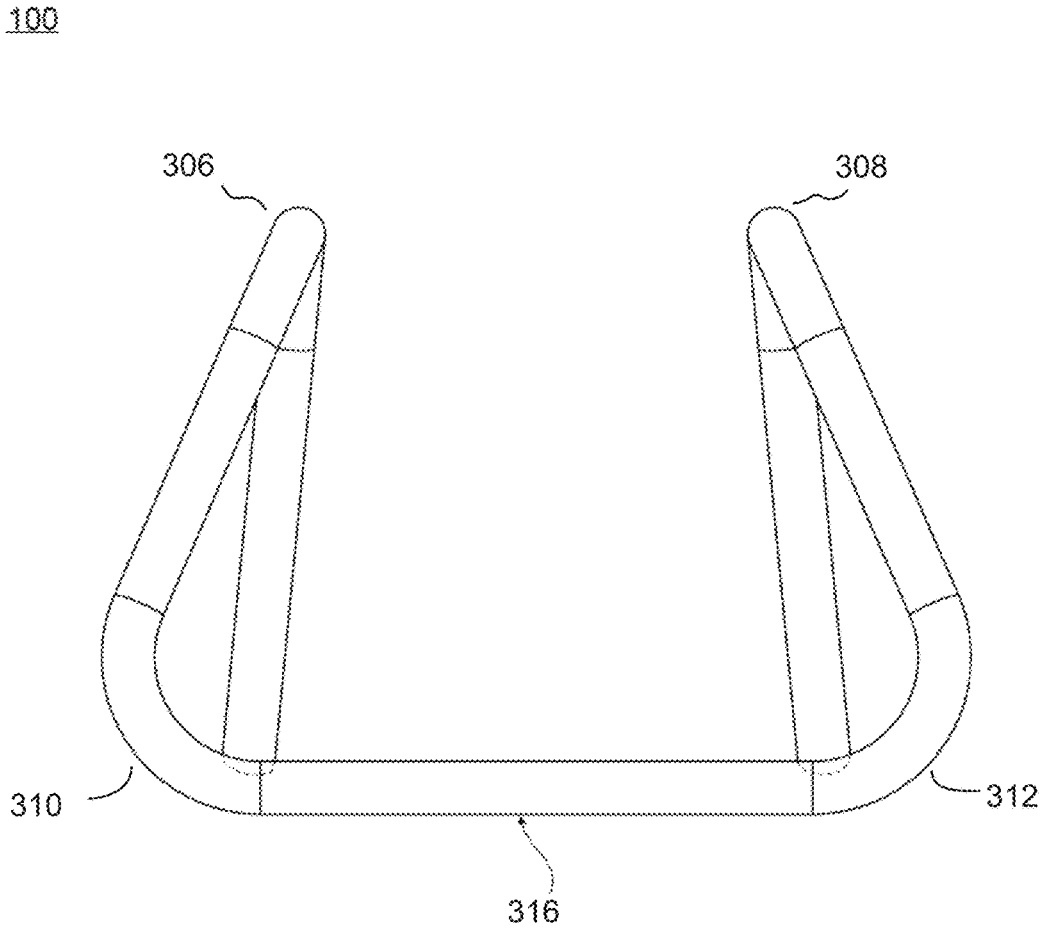
FIG. 5 is a front side view of the support structure embodiment of FIG. 1.

FIG. 5 is a front side view of the support structure 100 embodiment of FIG. 1. Rounded corners 306 to 312 and linear portion 316 are illustrated for clarity.

Figure 6:
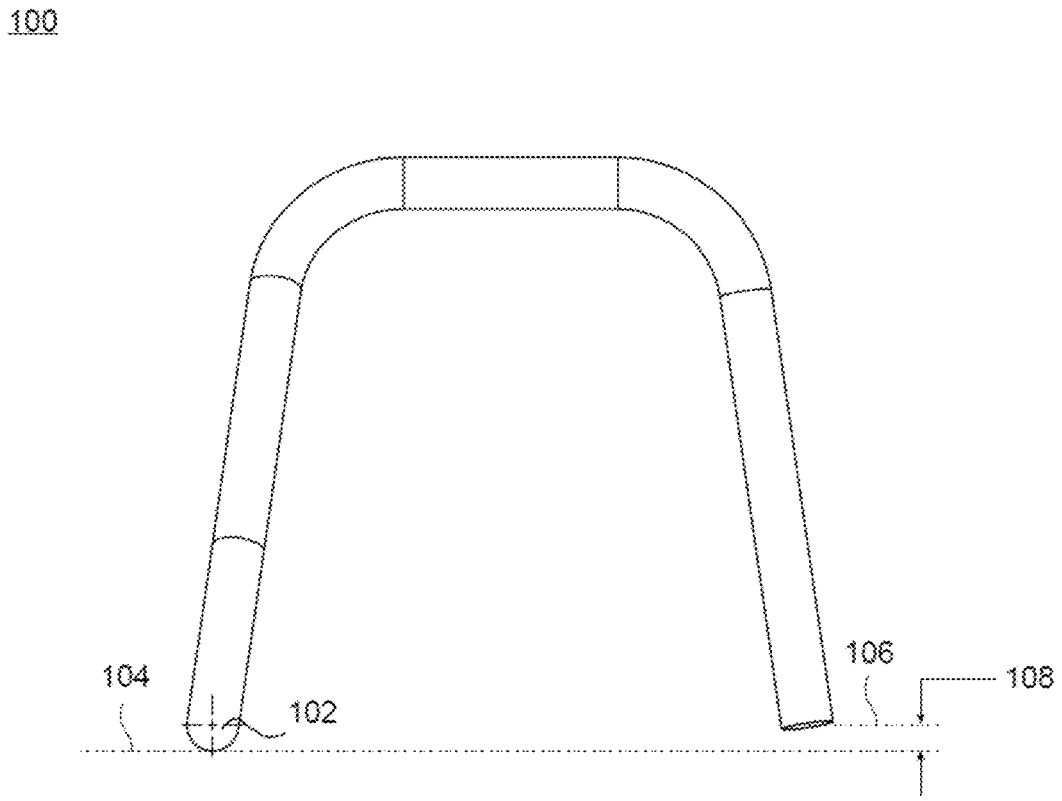
FIG. 6 is a right side view of the support structure embodiment of FIG. 1.

FIG. 6 is a right side view of the support structure 100 embodiment of FIG. 1. As illustrated in FIG. 6, a front side of support structure 100 is formed such that the tubular structure is bent to form a front, lower horizontal support member, which contacts the floor or the ground at a first level 104. Correspondingly, a second level 102 along the centerline 300 of the tube is represented in FIG. 6, along with a third level 106. The distance between the first level 104 and the second level 102 is represented as distance 108. The distance between the first level 104 and the third level 106 is also represented as distance 108. In some cases, distance 108 represents the radius of the tubular material that forms the support structure 100.

Figure 7:
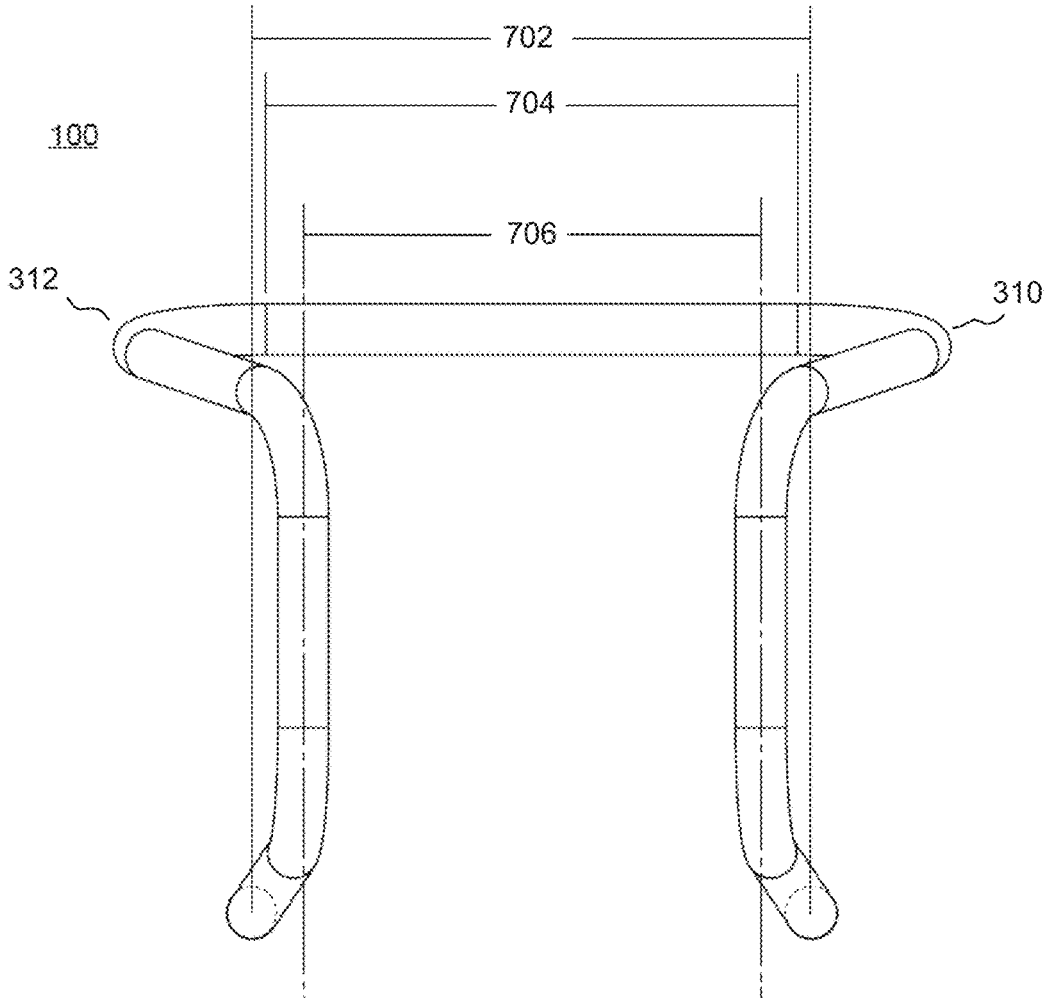
FIG. 7 is a top side view of the support structure embodiment of FIG. 1.

FIG. 7 is a top side view of the support structure 100 embodiment of FIG. 1. Particular rounded corners 310, 312 (FIGS. 3 and 4) along with certain measurements 702 to 706 are illustrated to further assist in understanding the support structure 100 embodiment. The measurements and the relationship between the measurements in FIG. 7 are non-limiting. Rather, measurements 702 to 706 illustrate desirable reference points for the embodiment. For example, measurement 702 may range from about 4 inches to about 20 inches. The length of measurement 702 is related to the size of the whole support structure embodiment 100. The length of measurement 702 is also related to the radius of particular corners 310, 312.

Measurement 704 may range from about 3 inches to about 19 inches. Measurement 704 corresponds to the length of edge L, the length of edge J, or the lengths edges L and J in the reference frustum 200 of FIG. 2B. The length of measurement 704 is related to the size of the whole support structure embodiment 100, the length of measurement 702, and certain ones of the angles of the support structure 100. With respect to the reference frustum 200 of FIGS. 2A-2D, the difference between measurements 702 and 704 illustrates that in some embodiments, the first planar side AHDL (FIG. 2C) and third planar side BFCJ (FIG. 2C) may have different lengths, different angles, or different lengths and different angles (i.e., different trapezoidal planes).

Measurement 706 may range from about 8 inches to 20 inches. Measurement 706 corresponds to the length of edge F, the length of edge H, or the lengths edges F and H in the reference frustum 200 of FIG. 2B.

Figure 8:
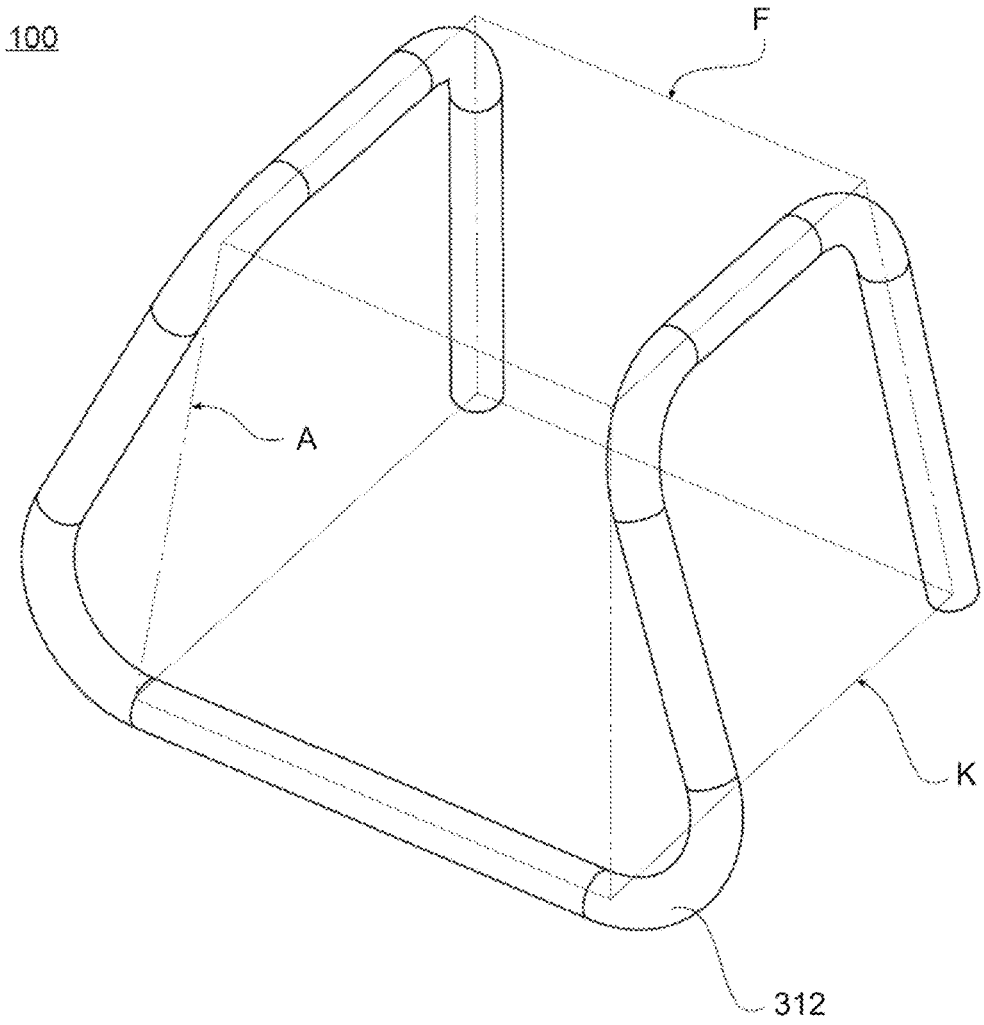
FIG. 8 is a perspective view of the support structure embodiment of FIG. 1 about the reference frustum of FIG. 2A.

FIG. 8 is a perspective view of the support structure 100 embodiment of FIG. 1 about the reference frustum 200 of FIG. 2A. Edges A, F, K, (FIG. 2B) and particular corner 312 (FIG. 3) are identified in FIG. 8 for clarity.

Figure 9:
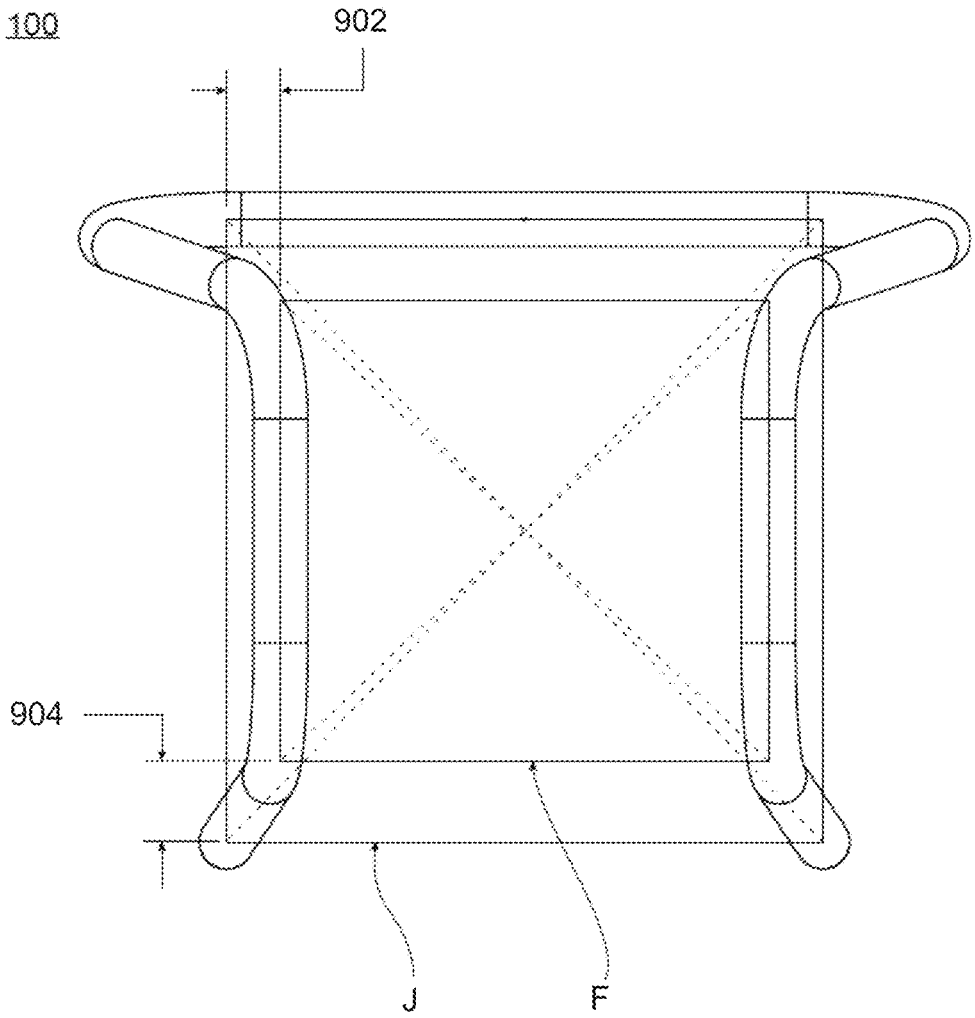
FIG. 9 is a top side view of the support structure embodiment of FIG. 1 about the reference frustum of FIG. 2A.

FIG. 9 is a top side view of the support 100 structure embodiment of FIG. 1 about the reference frustum 200 of FIG. 2A. Edges F and J (FIG. 2B) are identified in FIG. 8 for clarity. Measurement 902 in FIG. 9 illustrates the difference between measurements 702 and 706 (FIG. 7). Measurement 904 corresponds to about one half of the difference between the lengths of edges G and K (FIG. 2) and one half of the difference between the lengths edges E and I (FIG. 2). The difference between the lengths of edges G and K is substantially the same as the difference between the lengths of edges E and I.

In view of FIGS. 1, 2A to 2D, 8, and 9, the support structure 100 can be described by way of the reference frustum 200. Illustrated in FIGS. 8 and 9, the support structure 100 is formed about the reference frustum 200.

Prior to the formation, the support structure 100 may be formed as a straight length of tubular material, for example, thin-walled aluminum having an inside diameter of about 0.5 inches to about 2.0 inches. The straight length of tubular material may be about 50 inches to about 108 inches.

The support structure 100 begins at a point formed at the intersection of edges CJK (i.e., the lower right corner of second planar side CGDK (FIG. 2D)). Between the point of the support structure 100 formed at the intersection of edges CJK and a first bend in the support structure 100, a first vertical part of the support structure 100 corresponds to edge C. Edge C may be described as a first vertical part of support structure 100, which corresponds to a third edge (i.e., edge C) of the reference frustum 200 formed by the first planar side of the reference frustum 200 and the second planar side of the reference frustum 200.

The first bend in the support structure 100 along edges CG forms a first angle. A second bend in the support structure 100 along edges DG forms a second angle. A substantially straight section of the support structure 100 forms a first horizontal support member between the first bend and the second bend. The first horizontal support member may otherwise be described as corresponding to a first edge (i.e., edge G) of the reference frustum 200 formed by the first planar side of the reference frustum 200 and the planar top of the reference frustum 200.

A third bend in the support structure 100 along edges DL forms a third angle, and a fourth bend along edges AL forms a fourth angle. A substantially straight section of the support structure 100 forms a lower horizontal support member (i.e., edge L). As illustrated in FIG. 8, ground or floor contact points are formed at the lower part of the reference frustum 200. In some optional embodiments, the section formed as the lower horizontal support member is not substantially straight. Instead, in such optional embodiments, the lower horizontal support member has an arch with a particular radius of about 8 inches to about 8 feet or more.

The third bend and fourth bend of the support structure have a particular radius. The radius may be directed by the diameter of the tubular material. Accordingly, as illustrated in FIG. 8, some portions of the support structure 100 may be slightly exceed or impede the boundaries of the reference frustum 200. It is understood that the support structure 100 is still described as being formed about the reference frustum 200. When a person is using the support structure, the weight of the person is substantially distributed along the edges of the reference frustum 200.

Second and third vertical parts of the support structure 100 correspond, respectively to edges D and A. That is, the second vertical support structure is formed between the second bend and the third bend, and the third vertical support structure is formed between the third bend and a fourth bend. Edge D may be described as the second vertical part of the support structure 100, which corresponds to a fourth edge of the reference frustum 200 formed by the second planar side in the third planar side. Edge L may be described as the third vertical part of the support structure 100, which corresponds to a fifth edge of the reference frustum 200 formed by the third planar side and the fourth planar side of the reference frustum 200.

A fifth bend in the support structure 100 along edges AE forms a fifth angle, and a sixth bend along edges BE forms a sixth angle. Another substantially straight section of the support structure 100 forms a second horizontal support member (i.e., edge E) between the fifth bend and the sixth bend. The second horizontal support member may otherwise be described as corresponding to a second edge of the reference frustum 200 formed by the third planar side of the reference frustum 200 and the planar top of the reference frustum 200.

The support structure 100 terminates at a point formed at the intersection of edges BIJ. Between the point of the support structure 100 formed at the intersection of edges BIJ and the sixth bend in the support structure 100 formed along edges BE, a fourth vertical part of the support structure 100 corresponds to edge B. Edge B may be described as a fourth vertical part of support structure 100, which corresponds to a sixth edge (i.e., edge B) of the reference frustum 200 formed by the fourth planar side of the reference frustum 200 and the first planar side of the reference frustum 200.

In some embodiments (not shown), an optional third horizontal support member is formed as part of the support structure 100. The optional third horizontal support member corresponds to a third edge of the reference frustum 200 formed by the fourth planar side of the reference frustum 200 and the planar top of the reference frustum 200. With respect to FIG. 2B, the optional third horizontal support member would be arranged along edge H.

Figure 10:
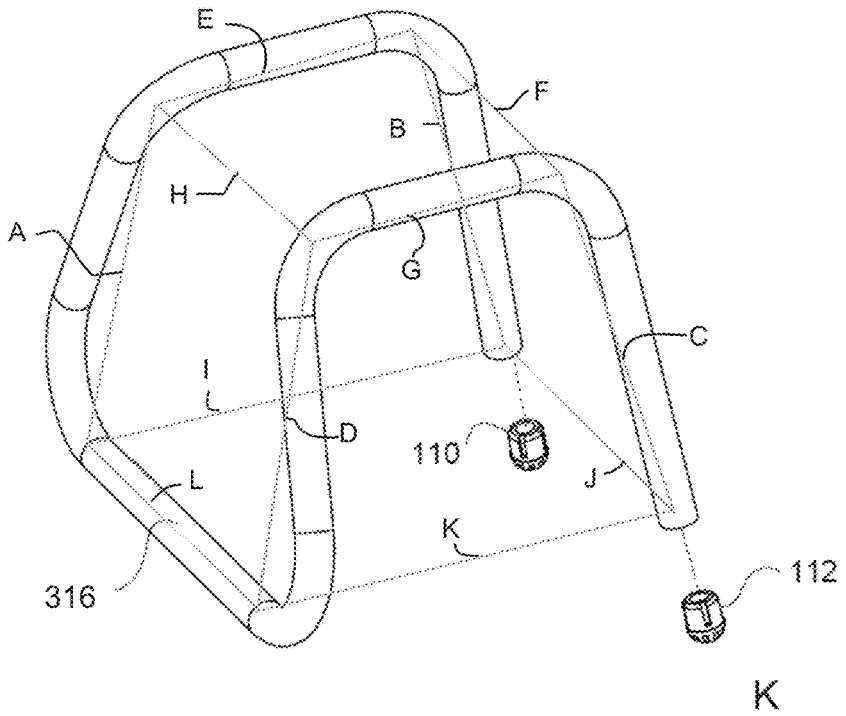
FIG. 10 is an exploded illustration of the support structure embodiment of FIG. 1 showing anti-skid material plugs.

FIG. 10 is an exploded illustration 600 of the support structure 100 embodiment of FIG. 1 showing optional anti-skid material plugs 110, 112. The optional plugs 110, 112 may be made of any material. In some cases, the plugs 110, 112 are plastic, and in other cases, the plugs 110, 112 are wood, polyurethane, rubber, or some other material. The plugs 110, 112 terminate the two ends of the tubular material bent or otherwise arranged to form of the support structure 100. The plugs may be compression fit (e.g., friction fit) into the ends of the tubular material. Alternatively, or in addition, some type of locking mechanism may also be employed. Generally speaking, plugs 110, 112 are arranged to mate with the inside diameter of the tubular material.

Plugs 110, 112 may be formed such that a portion of the plugs extending out from the end of the tubular material corresponds to distance 108 (FIG. 6). In this way, the support structure 100 which may include plugs 110, 112, begins at a point of the reference frustum 200 corresponding to the intersection of edges CJK and ends at a point of the reference frustum 200 corresponding to the intersection of edges BIJ. Stated differently, the antiskid material is applied to each end of the tube wherein a first end of the tube corresponds to a left-most point of the reference frustum 200 formed by the first trapezoidal perimeter and the third trapezoidal perimeter and a second end of the tube corresponds to right-most point of the reference frustum 200 formed by the second trapezoidal perimeter and the third trapezoidal perimeter.

Figure 11:
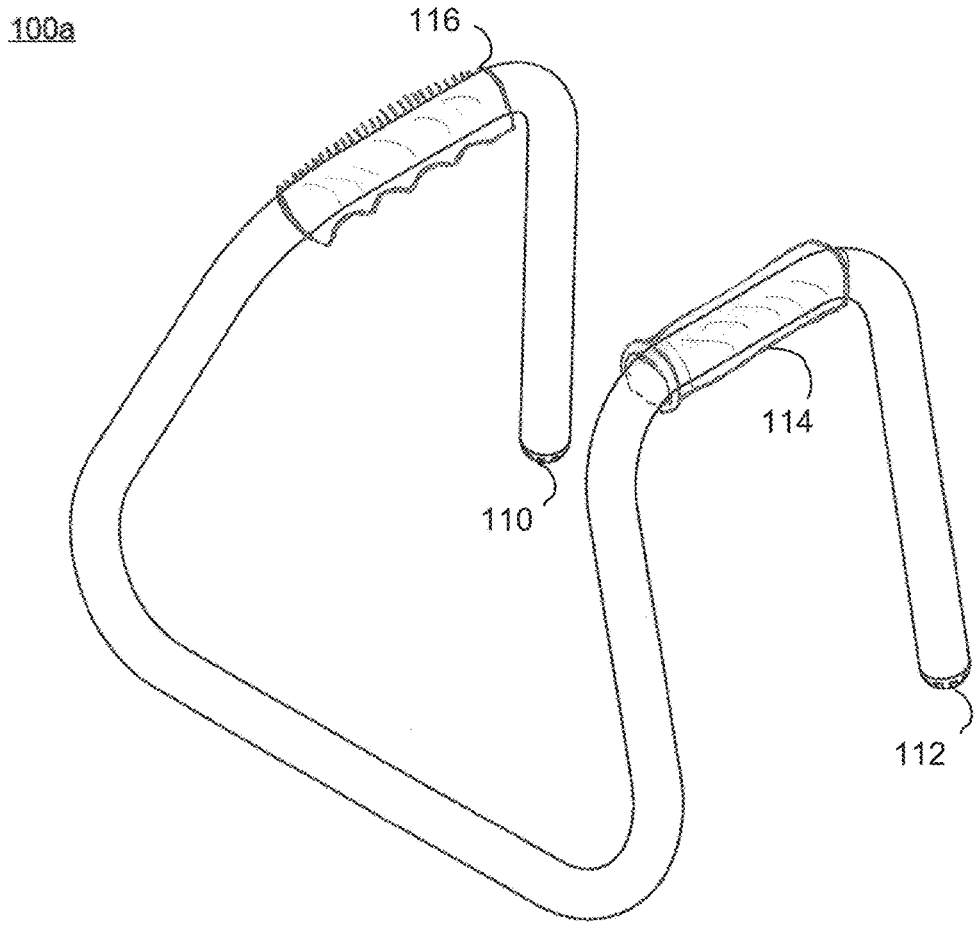
FIG. 11 is another embodiment of a support structure, which is similar to the support structure embodiment of FIG. 1 with optional features.

FIG. 11 is another embodiment of a support structure 100*a*, which is similar to the support structure 100 embodiment of FIG. 1 with optional anti-skid material plugs 110, 112 and optional handles 114 116. In some cases, the optional handles 114, 116 are identifiable features that may include decorations, visible markings, textured surfaces, or some combination thereof. The markings may include, for example, an illustration of a hand structure to visibly instruct or otherwise assist a user in the operation of the support structure. Alternatively, or in addition, the markings may include respective letters "R" and "L" to indicate where a person should place their right and left hands, arrows, contrasting colors, decorative colors, or some other visible features.

In some embodiments, the optional handles 114, 116 are textured surfaces (e.g., knurling, jeweling, beading, or the like) integrated with the horizontal support or otherwise attached thereto. The handles 114, 116 may be formed of rubber, plastic, or some other material selected for a desired comfort, friction, texture, or the like. In some other embodiments, the handles 114, 116 may have anatomically correct features to compliment a right hand, a left hand, or either hand. The handles 114, 116 may include other shaped features to assist a user in correct and safe operation of the support structure 100*a* such as bumps, protrusion, bulges, bulbs, knobs, protuberances, hollows, depressions, valleys, or the like. The handles 114, 116 may include other features such as a plurality of apertures, perforations, holes, slits, or the like to pass moisture from a hand and thereby facilitate useful friction. In some cases, the textured or otherwise shaped handles 114, 116 also include visible features described herein, for example, the decoration and visible marking "R" and "L" signifying, respectively, where on the anatomically complimentary structure a user should place their right hand and left hand.

Figure 12:
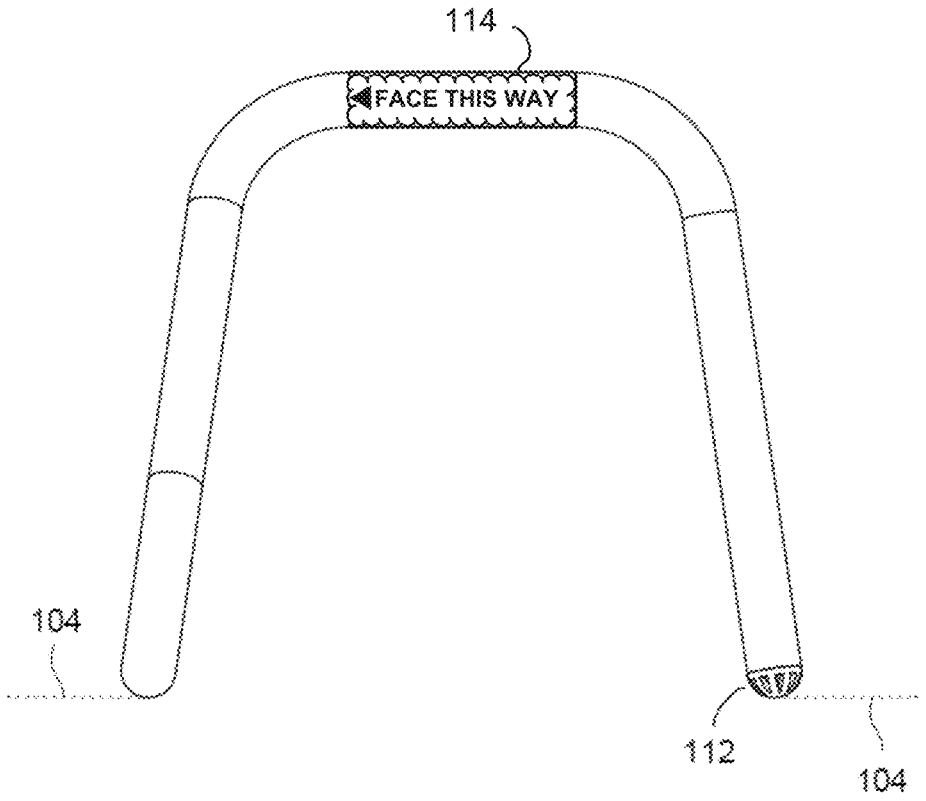
FIG. 12 is a right side view of the support structure embodiment of FIG. 1 with anti-skid material plugs.

FIG. 12 is a right side view of the support structure 100 embodiment of FIG. 1. One optional anti-skid material plug 112 is illustrated in FIG. 12. One optional handle feature 114 is illustrated in FIG. 12. The handle feature 114 is a visible marking, which may be decorative and which may or may not be textured. The handle feature 114 in FIG. 12 visibly instruct or otherwise assist a user in the operation of the support structure 100.

Figure 13:
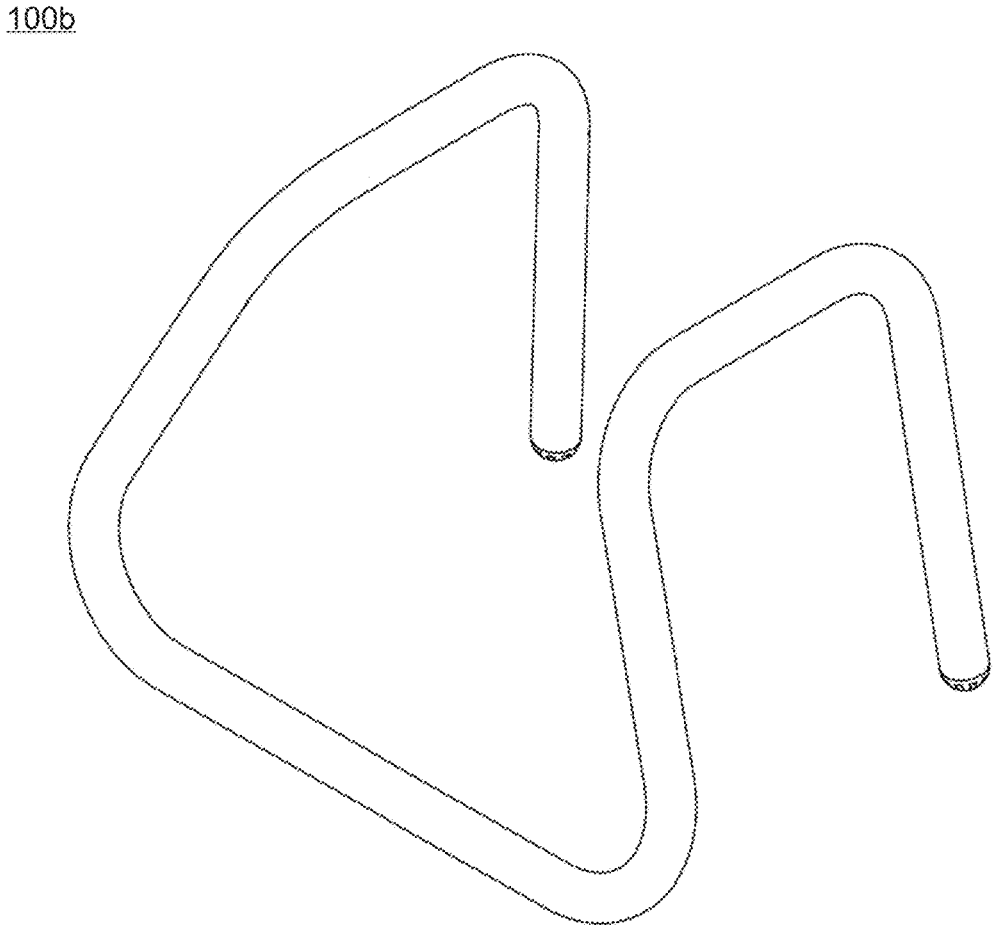
FIG. 13 a perspective view of another support structure embodiment.

FIG. 13 a perspective view of another support structure 100*b* embodiment. The support structure 100*b* of FIG. 13 bears similarity to the support structure 100 and support structure 100*a* of other figures in the disclosure. The embodiment of FIG. 13 clearly illustrates a support structure 100*b* formed from a single piece of material. The material may begin straight, such as a tube of thin-walled aluminum. Alternatively, the support structure 100*b* may be molded, poured, extruded, machine, or otherwise formed into a shape that substantially follows a reference frustum as discussed herein.

In some cases, support structures 100, 100*a*, and 100*b* are identical to each other. In other cases, support structures 100, 100*a*, and 100*b* are formed as a plurality of straight and curved segments which are assembled into shape as illustrated and described. Optionally, one or more couplings of the straight and curved segments are joined at one or more points. One or more of the points may be illustrated in, for example, as the substantially orthogonal lines across the tubular material of support structure 100. In some cases, the couplings are fixed and immovable. In some cases, the couplings are permitted to rotate fully or partially. In cases where the couplings are permitted to rotate fully or partially, the support structure may be manipulated (e.g., folded) for easier transportability.

Optionally, padding may be added to the first and second horizontal support members (i.e., along edges E and G, respectively; FIG. 2). The padding may cover a portion of the horizontal support members or the padding may cover the entire length of the horizontal support members. The padding may be rubber, plastic, cloth, or some other material. The padding may have anti-slip properties. The optional padding may be implemented as handles 114, 116 (FIGS. 11, 12).

In the foregoing description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with electronic and computing systems including client and server computing systems, as well as networks have not been shown or described in detail to avoid unnecessarily obscuring descriptions of the embodiments.

The terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Unless the context requires otherwise, throughout the specification and claims which follow, the word "comprise" and variations thereof, such as, "comprises" and "comprising" are to be construed in an open, inclusive sense, e.g., "including, but not limited to."

Reference throughout this specification to "one embodiment" or "an embodiment" and variations thereof means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

As described herein, for simplicity, patients, persons, human beings, and the like are in some case described in the context of the male gender. For example, the terms "his hand," "his left thumb," and the like are used. It is understood that human beings of any condition or status can be of any gender, and the terms "he," "his," and the like as used herein are to be interpreted broadly inclusive of all known gender definitions.

As described herein, terms such as stiff, soft, flexible, pliable, and the like are understood in their common and ordinary meaning. For example, stiff is not necessarily completely un-bendable. Instead, something that is stiff resistance deformation to a desired degree. The desired degree of stiffness may be measured, for example, in units such as foot pounds per inch or some other units. One structure may be stiffer than another structure. The increased (or decreased) stiffness may be caused by the devices being formed from different materials, from materials having different physical or chemical properties, or for some other reason. Correspondingly, the terms "flexible," "flexibility," "pliable," "soft," and the like impart a desired degree of flexibility or softness to the structure which the term modifies.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method performed by a human being to stand, the human being having a body, two hands, two legs, two feet, and at least one debilitated joint, the method comprising:

positioning a support structure in front of the human being, the support structure described by way of a reference frustum, the reference frustum having:

a first planar side and a third planar side each having a first trapezoidal perimeter, a second planar side and a fourth planar side each having second trapezoidal perimeter, a planar top having a first rectangular perimeter, and a planar bottom having a second rectangular perimeter, wherein each side of the first rectangular perimeter is shorter than a corresponding side of the second rectangular perimeter, wherein each parallel side of the second trapezoidal perimeter is shorter than a corresponding parallel side of the first trapezoidal perimeter, wherein the reference frustum has a height between 10 and 20 inches, wherein the first rectangular perimeter has a length between 10 and 16 inches, wherein the first rectangular perimeter has a width between 6 and 14 inches, wherein the second rectangular perimeter has a length between 12 and 18 inches, and wherein the second rectangular perimeter has a width between 8 and 16 inches, and wherein the support structure has exactly three horizontal support parts including:

a first horizontal support member corresponding to a first edge of the reference frustum formed by the second planar side and the planar top, a second horizontal support member corresponding to a second edge of the reference frustum formed by the fourth planar side and the planar top, and a third horizontal support member corresponding to a third edge of the reference frustum formed by the first planar side and the planar bottom, wherein the support structure has vertical support parts including:

a first vertical part corresponding to a third edge of the reference frustum formed by the first planar side and the second planar side, a second vertical part corresponding to a fourth edge of the reference frustum formed by the second planar side and the third planar side, a third vertical part corresponding to a fifth edge of the reference frustum formed by the third planar side and the fourth planar side, and a fourth vertical part corresponding to a sixth edge of the reference frustum formed by the fourth planar side and the first planar side;

grasping the first horizontal support member with a first of the two hands;

grasping the second horizontal support member with a second of the two hands;

distributing weight of the human being throughout portions of the support structure that correspond to edges of the reference frustum;

swinging a first of the two legs at least partially under the body;

supporting at least a first portion of the body through the two hands grasping the support structure;

supporting at least a second portion of the body with the first of the two legs; and raising the body upwards to a standing position.

2. The method of claim 1 wherein the debilitated joint is an artificial hip joint.

3. The method of claim 1 wherein the debilitated joint is an artificial knee joint.

4. The method of claim 1 wherein the human being is on a floor or the ground.

5. The method of claim 4, comprising:

placing the support structure in proximity to the human being prior to lying on the floor or the ground.

6. The method of claim 1, comprising:

releasing one of the two hands from the respective first or second horizontal support member while raising the body upwards.

7. A support structure device to assist a human patient to rise, comprising:

one or more substantially tubular components formed into a shape described by way of a reference frustum, the reference frustum having:

a first planar side and a third planar side each having a first trapezoidal perimeter, a second planar side and a fourth planar side each having second trapezoidal perimeter, a planar top having a first rectangular perimeter, and a planar bottom having a second rectangular perimeter, wherein each side of the first rectangular perimeter is shorter than a corresponding side of the second rectangular perimeter, wherein each parallel side of the second trapezoidal perimeter is shorter than a corresponding parallel side of the first trapezoidal perimeter, wherein the reference frustum has a height between 10 and 20 inches, wherein the first rectangular perimeter has a length between 10 and 16 inches, wherein the first rectangular perimeter has a width between 6 and 14 inches, wherein the second rectangular perimeter has a length between 12 and 18 inches, and wherein the second rectangular perimeter has a width between 8 and 16 inches;

wherein the one or more substantially tubular components are arranged along exactly three sides of the second trapezoidal perimeter, exactly three sides of the first trapezoidal perimeter, exactly three sides of the fourth trapezoidal perimeter, and exactly two sides of the third trapezoidal perimeter.

8. The support structure device of claim 7 wherein each of four corners of the second rectangle perimeter correspond to a ground contact point of the support structure.

9. The support structure device of claim 7 wherein at least some of the one or more substantially tubular components are metal.

10. The support structure device of claim 7 wherein at least some of the one or more substantially tubular components are stainless steel, aluminum, an aluminum alloy, or a composite material.

11. The support structure device of claim 7, comprising:

an anti-skid material applied to each terminal end of the one or more substantially tubular components wherein a first terminal end of the one or more substantially tubular components corresponds to a left-most point of the reference frustum formed at a common edge shared by the second trapezoidal perimeter and the third trapezoidal perimeter and a second terminal end of the one or more substantially tubular components corresponds to aright-most point of the reference frustum formed at a common edge shared by the fourth trapezoidal perimeter and the third trapezoidal perimeter.

12. The support structure device of claim 11 wherein the anti-skid material is substantially a polyurethane material or a rubber material.

13. The support structure device of claim 7, comprising:

a first horizontal support member corresponding to a first edge of the reference frustum shared by the first planar side and the planar bottom;

a second horizontal support member corresponding to a second edge of the reference frustum shared by the second planar side and the planar top; and a third horizontal support member corresponding to a third edge of the reference frustum shared by the fourth planar side and the planar top.

14. The support structure device of claim 10 wherein at least some portion of the one or more substantially tubular components is cushioned.

15. The support structure device of claim 10 wherein at least some portion of the one or more substantially tubular components includes a chromed surface, an electrochemically colored surface, or an enamel surface.

16. The support structure device of claim 10 wherein at least one portion of the one or more substantially tubular components includes at least one identifiable feature indicating where a user's right hand, left hand, or both hands should be placed.

17. The support structure device of claim 16 wherein at least one identifiable feature includes at least one of a decoration, a visible marking, a textured surface, and an anatomically complimentary structure.

18. A support frame for assisting a human being to move upwards, the human being having two arms, two hands, two legs, and at least one infirmed joint, the support frame comprising:

a single conduit structure suitably bent into a shape described by way of a reference frustum, the reference frustum having:

a first planar side and a third planar side each having a first trapezoidal perimeter, a second planar side and a fourth planar side each having second trapezoidal perimeter, a planar top having a first rectangular perimeter, and a planar bottom having a second rectangular perimeter, wherein each side of the first rectangular perimeter is shorter than a corresponding side of the second rectangular perimeter, wherein each parallel side of the second trapezoidal perimeter is shorter than a corresponding parallel side of the first trapezoidal perimeter, wherein the reference frustum has a height between 10 and 20 inches, wherein the first rectangular perimeter has a length between 10 and 16 inches, wherein the first rectangular perimeter has a width between 6 and 14 inches, wherein the second rectangular perimeter has a length between 12 and 18 inches, and wherein the second rectangular perimeter has a width between 8 and 16 inches;

wherein the single conduit structure is arranged along three sides of the second trapezoidal perimeter, three sides of the first trapezoidal perimeter, and three sides of the fourth trapezoidal perimeter.

19. The support frame of claim 18 wherein the single conduit structure has a substantially square cross-section.

20. The support frame of claim 18, comprising:

at least one identifiable feature having at least one of a decoration, a visible marking, a textured surface, and an anatomically complimentary structure indicating where a user's right hand, left hand, or both hands should be placed.

* * * * *